US007937856B2

(12) United States Patent
Cook et al.

(10) Patent No.: US 7,937,856 B2
(45) Date of Patent: May 10, 2011

(54) ARTICLE OF FOOTWEAR WITH ILLUMINATED CHAMBER

(75) Inventors: Christopher S. Cook, Portland, OR (US); Steven S Smith, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 731 days.

(21) Appl. No.: 11/962,361

(22) Filed: Dec. 21, 2007

(65) Prior Publication Data

US 2009/0158622 A1 Jun. 25, 2009

(51) Int. Cl.
*A43B 23/00* (2006.01)

(52) U.S. Cl. ..... 36/137; 362/103; 362/101

(58) Field of Classification Search ..... 362/84, 362/101, 103

See application file for complete search history.

(56) References Cited

U.S. PATENT DOCUMENTS

| | | | | |
|---|---|---|---|---|
| 3,893,247 | A | 7/1975 | Dana, III | |
| 4,020,572 | A | 5/1977 | Chiaramonte, Jr. | |
| 4,130,951 | A | 12/1978 | Powell | |
| 4,158,922 | A | 6/1979 | Dana, III | |
| 4,848,009 | A | 7/1989 | Rodgers | |
| D332,687 | S | 1/1993 | Altman et al. | |
| 5,237,760 | A | 8/1993 | Altman et al. | |
| 5,303,485 | A | 4/1994 | Goldston et al. | |
| 5,381,615 | A | 1/1995 | MacMillan | |
| 5,408,764 | A | 4/1995 | Wut | |
| D363,372 | S | 10/1995 | Hatfield et al. | |
| 5,483,759 | A | 1/1996 | Silverman | |
| 5,500,635 | A * | 3/1996 | Mott | 340/323 R |
| 5,546,681 | A | 8/1996 | Goldston et al. | |
| 5,644,858 | A | 7/1997 | Bemis | |
| 5,692,324 | A | 12/1997 | Goldston et al. | |
| 5,771,611 | A | 6/1998 | Chang | |
| 5,813,148 | A | 9/1998 | Guerra | |
| 5,903,103 | A | 5/1999 | Garner | |
| 5,945,911 | A | 8/1999 | Healy et al. | |
| 5,969,479 | A | 10/1999 | Wong | |
| 6,012,822 | A | 1/2000 | Robinson | |
| 6,195,921 | B1 | 3/2001 | Truong | |
| RE37,220 | E | 6/2001 | Rapisarda et al. | |
| 6,457,261 | B1 | 10/2002 | Crary | |
| 6,837,590 | B2 | 1/2005 | Marston | |
| 6,843,578 | B1 | 1/2005 | Cheung | |
| 6,906,472 | B2 | 6/2005 | Wong | |
| 6,991,342 | B2 | 1/2006 | Gonet | |
| 7,059,070 | B2 | 6/2006 | Omstead et al. | |
| 7,067,986 | B2 | 6/2006 | Wong et al. | |
| 7,752,426 | B2 * | 7/2010 | Nye et al. | 712/240 |
| 2003/0126769 | A1 | 7/2003 | Chen | |

FOREIGN PATENT DOCUMENTS

| | | | |
|---|---|---|---|
| GB | 2 314 251 | A | 12/1997 |
| WO | 2007/139979 | A2 | 12/2007 |
| WO | 2008/109651 | A1 | 9/2008 |

OTHER PUBLICATIONS

International Search Report mailed Mar. 27, 2009 in corresponding PCT application No. PCT/US2008/085289.

* cited by examiner

*Primary Examiner* — Anabel M Ton
(74) *Attorney, Agent, or Firm* — Banner & Witcoff, Ltd.

(57) ABSTRACT

An article of footwear includes an upper and a sole assembly secured to the upper. The sole assembly has at least one fluid-filled chamber capable of transmitting light and a recess. A light source is positioned in the recess, and an outsole is secured to a lower surface of the sole assembly.

21 Claims, 3 Drawing Sheets

ARTICLE OF FOOTWEAR WITH ILLUMINATED CHAMBER

FIELD OF THE INVENTION

This invention relates generally to footwear, and, in particular, to footwear having a sole assembly with an illuminated chamber.

BACKGROUND OF THE INVENTION

Articles of footwear with light emitting elements or light sources have been configured in a variety of manners. The light sources may allow the user to be seen in reduced lighting environments, provide aesthetic benefits, and assist in measuring and analyzing movements of the user.

It would be desirable to provide an article of footwear with light emitting elements that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with an illuminated chamber. In accordance with a first aspect, an article of footwear includes an upper and a sole assembly secured to the upper. The sole assembly has at least one fluid-filled chamber capable of transmitting light and a recess. A light source is positioned in the recess, and an outsole is secured to a lower surface of the sole assembly.

In accordance with another aspect, an article of footwear includes an upper and a midsole secured to the upper. A sole assembly is secured to the upper and includes a plurality of support columns, with each support column including a fluid-filled chamber capable of transmitting light and including a recess in an upper surface thereof. Each of a plurality of light sources is positioned in a corresponding recess. An outsole is secured to a lower surface of the sole assembly.

In accordance with a further aspect, an article of footwear includes an upper and a midsole secured to the upper. A sole assembly is secured to the midsole and includes a plurality of support columns. Each support column includes a top plate, a bottom plate, and a fluid-filled chamber capable of transmitting light positioned between the top and bottom plates. Each fluid-filled chamber includes a recess in an upper surface thereof. Each of a plurality of LEDs is positioned in a corresponding recess. A battery is operably connected to the LEDs and a switch is operably connected to the battery. An outsole is secured to a lower surface of the sole assembly.

Substantial advantage is achieved by providing an article of footwear with an illuminated support column. In particular, certain embodiments of an article of footwear with an illuminated support column provide enhanced visibility for a user in dark or reduced lighting situations, as well as aesthetic benefits.

These and additional features and advantages disclosed here will be further understood from the following detailed disclosure of certain embodiments.

Figure 1:
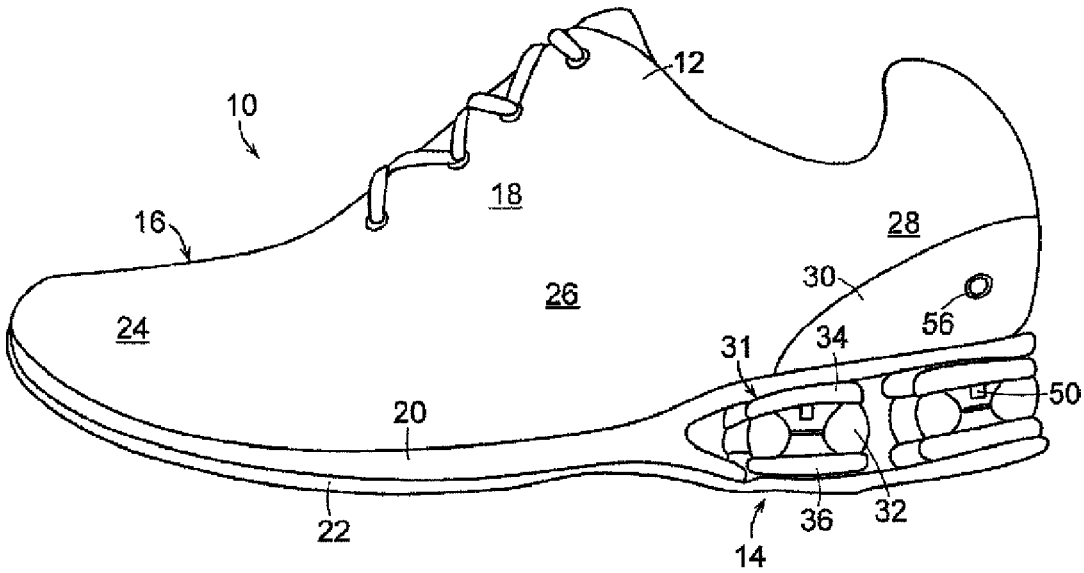
FIG. 1 is a perspective view of an article of footwear with a plurality of fluid-filled chambers with light sources contained therein.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Sole assembly 14 may be secured to upper 12 by adhesive or any other suitable means. Footwear 10 has a medial, or inner, side 16 and a lateral, or outer, side 18.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole 15 located within upper 12 (shown in FIG. 4), a midsole 20, and an outsole 22.

Upper 12 forms an interior void that comfortably receives a foot and secures the position of the foot relative to sole assembly 14. The configuration of upper 12, as depicted, is suitable for use during athletic activities, e.g., running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Midsole 20 is attached to upper 12 and functions as the primary shock-attenuating and energy-absorbing component of footwear 10. Midsole 20 may be secured to upper 12 by adhesive or other suitable means. Outsole 22 is attached to the lower surface of midsole 20 by adhesive or other suitable means. Suitable materials for outsole 22 include traditional rubber materials. Other suitable materials for outsole 22 will become readily apparent to those skilled in the art, given the benefit of this disclosure. In certain embodiments, sole assembly 14 may not include an outsole layer separate from midsole 20 but, rather, the outsole may comprise a bottom surface of midsole 20 that provides the external traction surface of sole assembly 14.

For purposes of general reference, as illustrated here, footwear 10 may be divided into three general portions: a forefoot portion 24, a midfoot portion 26, and a heel portion 28. Portions 24, 26, and 28 are not intended to demarcate precise areas of footwear 10. Rather, portions 24, 26, and 28 are intended to represent general areas of footwear 10 that provide a frame of reference during the following discussion.

Unless otherwise stated, or otherwise clear from the context below, directional terms used herein, such as rearwardly, forwardly, top, bottom, inwardly, downwardly, upwardly, interior, exterior, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 28, that is, to the left as seen in FIG. 1. Naturally, forwardly is toward forefoot portion 24, that is, to the right as seen in FIG. 1, and downwardly is toward the bottom of the page as seen in FIG. 1. Top refers to elements toward the top of the page as seen in FIG. 1, while bottom refers to elements toward the bottom of the page as seen in FIG. 1. Inwardly or interior is toward the center of footwear 10, and outwardly or exterior is toward the outer peripheral edge of footwear 10.

Sole assembly 14 may include a heel counter 30 positioned in heel portion 28, which captures rear portion 28 of upper 12. Sole assembly 14 includes at least one fluid-filled chamber that enhances the ground reaction force attenuation properties of sole assembly 14. It is to be appreciated that the fluid-filled chambers may be pressurized chambers, or non-pressurized chambers that are at ambient pressure. In the illustrated embodiment, a plurality of support columns 31 are provided and include fluid-filled chambers 32.

In the illustrated embodiment, support columns 31 are positioned in heel portion 28, and specifically, four such support columns 31 are found in the illustrated embodiment. It is to be appreciated, however, that any number of support columns 31 could be positioned in any of forefoot portion 24, midfoot portion 26 and heel portion 28.

Fluid-filled chambers 32 are formed of a light transmitting material such as thermoplastic urethane (TPU), a multi-layer film, or micro-layer films. Examples of Patents describing such chambers include, but are not limited to U.S. Pat. Nos. 6,013,340; 6,082,025; 6,203,868; 6,391,405; 6,599,597; and 7,730,379, hereby incorporated by reference in their entirety. Other suitable materials for fluid-filled chambers 32 will become readily apparent to those skilled in the art, given the benefit of this disclosure.

In certain embodiments, support columns 31 include an upper plate 34 that is secured to a lower surface of midsole 20 by adhesive or other suitable fastening means and receives a top portion of a fluid-filled chamber 32. Similarly, a lower plate 36 is secured by adhesive or other suitable fastening means to outsole 22, or to an individual outsole portion 22, and receives a lower portion of fluid-filled chamber 32. Upper and lower plates 34, 36 serve to capture fluid-filled chamber 32 and help position it within sole assembly 14 as well as enhance the cushioning and support characteristics of support columns 31. Upper and lower plates 34, 36 may be formed of an elastomeric material such as TPU, a polyether block copolyamide (sold as Pebax® by ATOFINA Chemicals of Philadelphia, Pa.), or a composite material, for example. Other suitable materials for upper and lower plates 34, 36 will become readily apparent to those skilled in the art, given the benefit of this disclosure.

Figure 2:
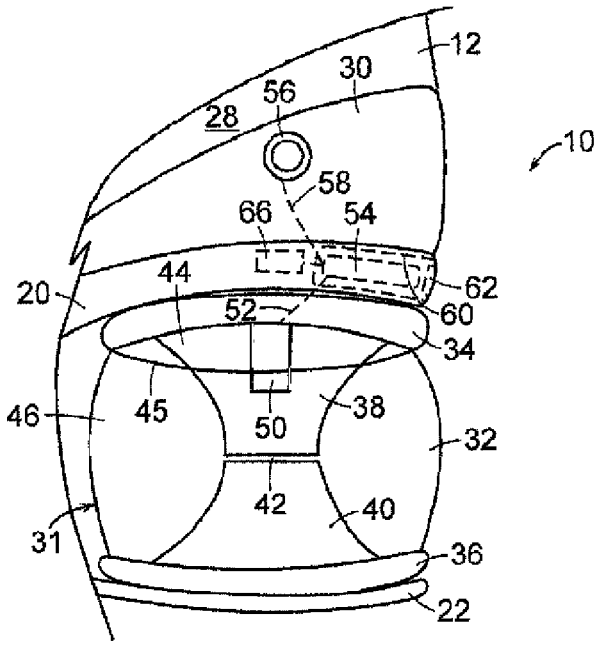
FIG. 2 is an enlarged elevation view of a heel portion of the article of footwear of FIG. 1.

As seen in greater detail in FIG. 2, a recess 38 is formed in an upper surface of fluid-filled chamber 32. In certain embodiments recess 38 may be an upper recess 38 with a corresponding lower recess 40 positioned beneath recess 38, and a barrier portion 42 extending within fluid-filled chamber 32 and separating recess 38 from lower recess 40.

In certain embodiments, fluid-filled chamber 32 is formed of an upper sheet 44 bonded about is peripheral edge 45 to a lower sheet 46. In the illustrated embodiment, lower sheet 46 is substantially bowl-shaped with upper sheet 44 forming a lid for the bowl shape. A central portion of upper sheet 44 is then welded to, or otherwise sealed with, a central portion of lower sheet 46, thereby forming barrier portion 42. Thus, fluid-filled chamber 32 has a substantially toroidal shape or donut-like shape, with barrier portion 42 extending across the central portion of the toroidal shape.

A light source 50 is positioned within at least one recess 38. Light source 50 is positioned so as to project light outwardly through fluid-filled chamber 32. In certain embodiments, light source 50 is secured to upper plate 34 and projects downwardly into recess 38. Light source 50 provides safety and aesthetic benefits for users of footwear 10. In certain embodiments, light source 50 is a light-emitting-diode (LED). It is to be appreciated that other light sources, such as fiber optics or electroluminescent panels, for example, may be suitable for use in footwear 10.

It is to be appreciated that, in certain embodiments, light source 50 could be positioned in one or more lower recess 40, or that light sources 50 could be positioned in both at least one upper recess 38 and at least one lower recess 40.

Light source 50 is operably connected by a cable 52 to a power source 54. Power source 54 may be a battery, such as a 1.5 v battery often found in watches and the like. A switch 56 may be provided in footwear 10, and serves to control the operation of light source 50. Switch 56 is operably connected to one of power source 54 and light source 50 by a cable 58. Switch 56 may be a push-button switch, or any other type of switch suitable for connection with power source 54. As seen here, switch 56 is provided in a lateral sidewall of heel counter 30. However, it is to be appreciated that switch 56 can be provided in any desired location in footwear 10.

Figure 3:
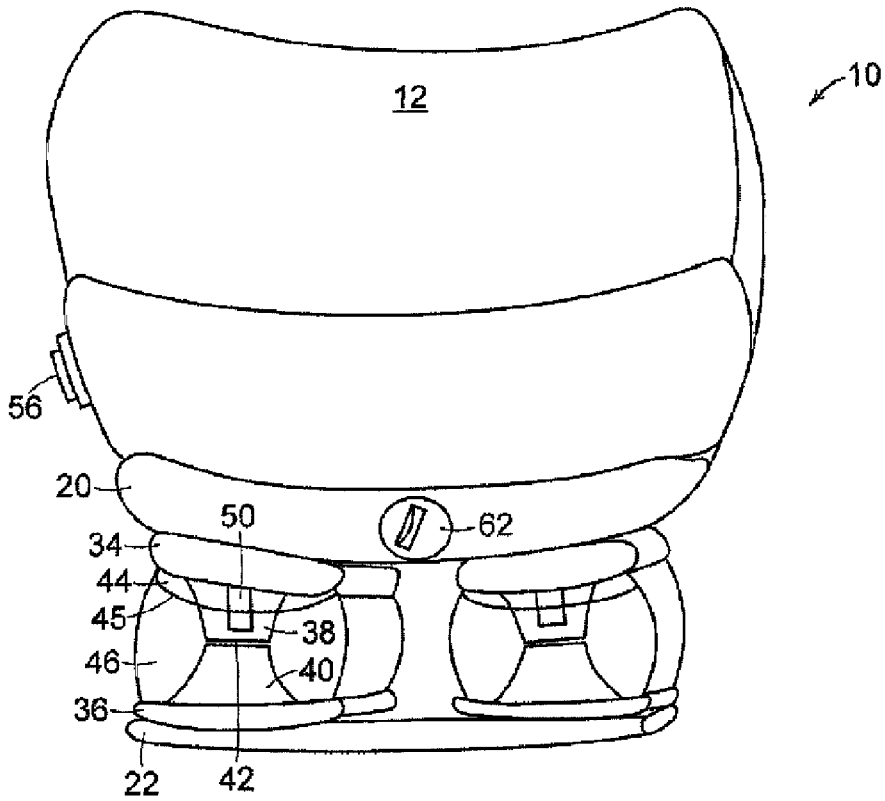
FIG. 3 is a rear elevation view of the article of footwear of FIG. 1.

In the illustrated embodiment, power source 54 is positioned in heel portion 28 of midsole 20. It is to be appreciated that power source 54 can be positioned in any desired location in footwear 10. Power source 54 may be positioned in a recess 60 formed in midsole 20. As seen in FIG. 3, a removable cover 62 is seen covering recess 60, thereby allowing power source 54 to be replaced. Cover 62 may be threadingly engaged in recess 60. A slot 64 may be formed in cover 62, thereby allowing the user to untwist cover 62 with a coin, screwdriver or any other narrow item.

It is to be appreciated that light sources 50 may emit light of any color, and that each light source 50 may emit the same color of light as all of the other light sources 50, that each light source 50 may emit a color of light different from each of the other light sources 50, or that some light sources 50 may emit the same color as some other light sources 50 while some light sources 50 are different. Thus, it can be appreciated that any combination of colors of light may be emitted by the different light sources 50.

In certain embodiments, when one or more light sources 50 are on, they are illuminated in a steady on condition, while in other embodiments, one or more light sources 50 may flash on an off intermittently. In such embodiments, a controller 66 may be operably connected to power source 54 and/or switch 56 to control the operation of light sources 50. Light sources 50 could flash in a random on and off manner, or they could be sequenced in a desired fashion. Controller 66 may be an integrated circuit, or chip, or any other suitable mechanism for controlling the operation and sequencing of one or more light sources 50, and can be positioned at any desired location within footwear 10.

Figure 4:
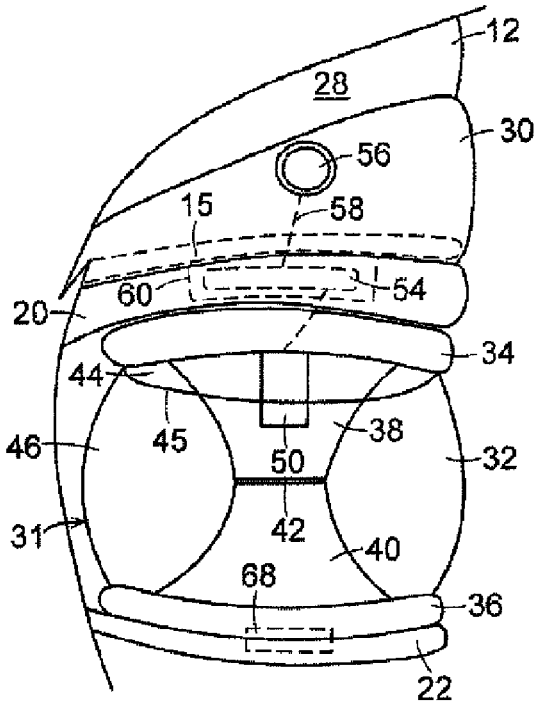
FIG. 4 is an enlarged elevation view of a heel portion of an alternative embodiment of the article of footwear of FIG. 1.

Additionally, in certain embodiments, light sources 50 could be activated by a pressure sensitive switch 68, as seen in FIG. 4. In such an embodiment, one or more light sources 50 are activated when the user's foot impacts the ground or any other surface with which footwear 10 comes into contact. Each light source 50 could have its own pressure sensitive switch 68, or a single pressure sensitive switch 68 could activate each light source 50. Each pressure sensitive switch 68 is connected by a cable, not shown, to power source 54.

In certain embodiments, as seen in FIG. 4, recess 60 within which power source 54 is received, may be accessible beneath insole 15, allowing the user to replace power source 54 when it is depleted or damaged.

Figure 5:
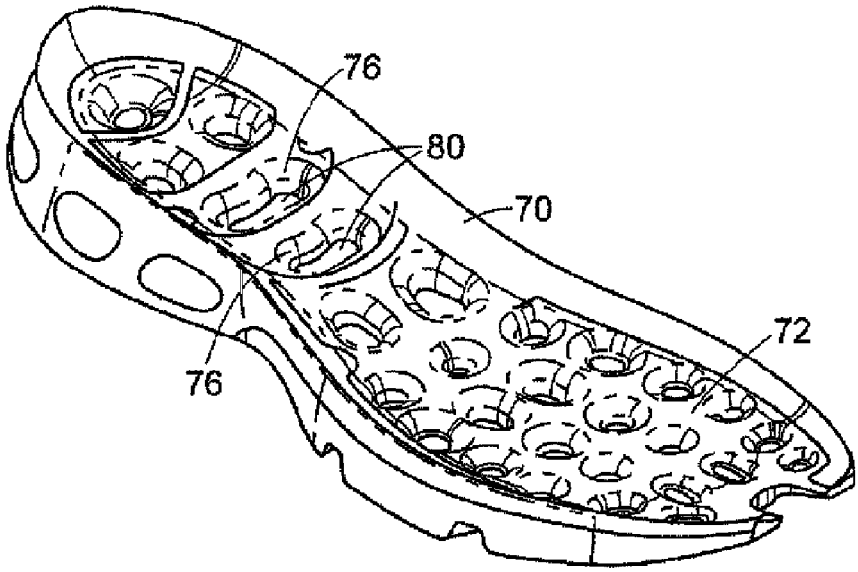
FIG. 5 is a perspective view of a fluid-filled chamber of an alternative embodiment of an article of footwear that is configured to receive light sources therein.
Figure 6:
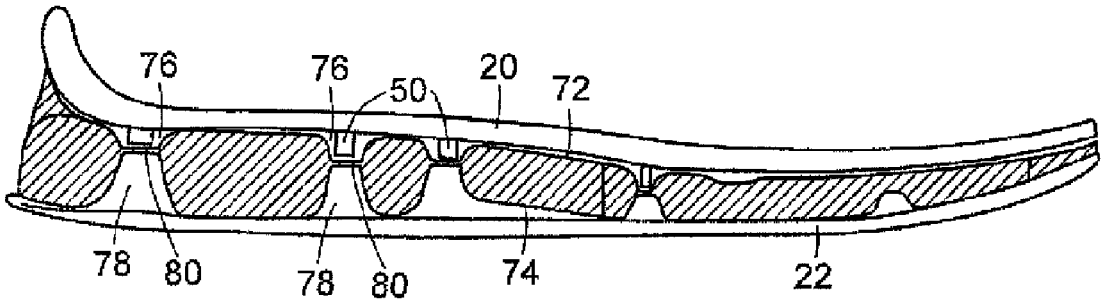
FIG. 6 is section view of the midsole of FIG. 5 shown beneath a midsole with light sources contained therein.

Another embodiment is shown in FIGS. 5-6, in which sole assembly 14 includes a fluid-filled chamber 70 positioned beneath midsole 20, with outsole 22 secured to a lower surface of fluid-filled chamber 70. In certain embodiments, fluid-filled chamber 70 is formed of an upper sheet 72 bonded about is peripheral edge to a lower sheet 74. Upper sheet 72 is then welded to, or otherwise sealed with, lower sheet 74 at a plurality of locations, defining a plurality of upper recesses 76 in the upper surface of fluid-filled chamber 70 and a mating plurality of lower recesses 78 formed in the lower surface of fluid-filled chamber 70, with a barrier portion 80 formed between each upper recess 76 and mating lower recess 78. A light source 50 is positioned within at least one upper recess 76, and is operably connected to a power source and functions as described above.

Fluid-filled chambers 70 are formed of a light transmitting material such as such as thermoplastic urethane (TPU), a multi-layer film, or micro-layer films. Examples of Patents describing such chambers include, but are not limited to U.S. Pat. Nos. 6,013,340; 6,082,025; 6,203,868; 6,391,405; 6,599,597; and 7,730,379, hereby incorporated by reference in their entirety. Other suitable materials for fluid-filled chambers 70 will become readily apparent to those skilled in the art, given the benefit of this disclosure.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising:
an upper;
a sole assembly secured to the upper and including:
at least one support column comprising a fluid-filled chamber capable of transmitting light and including a recess, an upper plate, and a lower plate, with the fluid-filled chamber being positioned between the upper plate and the lower plate; and
a light source positioned in the recess; and
an outsole secured to a lower surface of the sole assembly.

2. The article of footwear of claim 1, further comprising at least one additional light source positioned in a recess of a fluid-filled chamber capable of transmitting light.

3. The article of footwear of claim 2, wherein the light sources flash on and off intermittently.

4. The article of footwear of claim 2, wherein the light sources flash on and off in a desired sequence.

5. The article of footwear of claim 2, wherein at least one of the light sources emits a color of light different than a color of light emitted by at least one other light source.

6. The article of footwear of claim 1, further comprising a power source operably connected to the light source.

7. The article of footwear of claim 6, wherein the power source is a battery.

8. The article of footwear of claim 6, wherein the power source is positioned in the sole assembly.

9. The article of footwear of claim 6, further comprising a midsole have a recess formed therein, the power source being positioned in the midsole recess.

10. The article of footwear of claim 9, wherein the midsole recess includes a cover.

11. The article of footwear of claim 1, further comprising a midsole positioned between the sole assembly and the upper.

12. The article of footwear of claim 1, wherein the fluid-filled chambers are positioned in a heel portion of the sole assembly.

13. The article of footwear of claim 1, wherein the light source is an LED.

14. The article of footwear of claim 1, further comprising a switch to control operation of the light source.

15. The article of footwear of claim 14, further comprising a pressure sensitive switch to control operation of the light source.

16. An article of footwear comprising:
an upper;
a midsole secured to the upper;
a sole assembly secured to the upper and including:
a plurality of support columns, each support column including a fluid-filled chamber capable of transmitting light, a recess in an upper surface thereof, an upper plate and a lower plate, with the fluid-filled chamber being positioned between the upper plate and the lower plate; and
a plurality of light sources, each light source being positioned in a corresponding recess; and
an outsole secured to a lower surface of the sole assembly.

17. The article of footwear of claim 16, further comprising a switch to control operation of the light sources.

18. The article of footwear of claim 16, wherein each light source is an LED.

19. An article of footwear comprising:
an upper;
a midsole secured to the upper;
a sole assembly secured to the midsole and including:
a plurality of support columns, each support column including a top plate, a bottom plate, and a fluid-filled chamber capable of transmitting light positioned between the top and bottom plates, with each fluid-filled chamber including a recess in an upper surface thereof; and
a plurality of LEDs, each LED being positioned in a corresponding recess;
a battery operably connected to the LEDs;
a switch operably connected to the battery; and
an outsole secured to a lower surface of the sole assembly.

20. An article of footwear comprising:
an upper;
a sole assembly secured to the upper and including:
at least one fluid-filled chamber including a recess formed in an upper surface thereof; and
a light source positioned in the recess; and
an outsole secured to a lower surface of the sole assembly.

21. The article of footwear of claim 20, wherein the sole assembly includes a fluid-filled bladder, a plurality of recesses being formed in an upper surface of the bladder.

* * * * *